United States Patent [19]

Wageman

[11] Patent Number: 4,972,635

[45] Date of Patent: Nov. 27, 1990

[54] CANT VENT AND RIM GUARD AIR AND MOISTURE STOPS

[76] Inventor: Gerald L. Wageman, 1301 Rushmore Dr., Burnsville, Minn. 55337

[21] Appl. No.: 297,618

[22] Filed: Jan. 17, 1989

[51] Int. Cl.[5] ..... E04B 7/00

[52] U.S. Cl. ..... 52/94; 52/404

[58] Field of Search ..... 52/94, 95, 406, 404

[56] References Cited

U.S. PATENT DOCUMENTS

| | | | |
|---|---|---|---|
| 332,491 | 12/1885 | Clay . | |
| 405,794 | 6/1889 | O'Donnell . | |
| 498,563 | 5/1893 | Montgillion . | |
| 1,924,515 | 8/1933 | Reinke . | |
| 2,022,161 | 11/1935 | Spafford | 52/406 |
| 3,160,987 | 12/1964 | Pinkley | 52/95 |
| 4,069,628 | 1/1978 | Kreimer | 52/94 |
| 4,184,416 | 1/1980 | Koontz | 52/95 |
| 4,185,433 | 1/1980 | Cantrell | 52/94 |
| 4,189,878 | 2/1980 | Fitzgerald | 52/95 |
| 4,223,489 | 9/1980 | Bentley | 52/92 |
| 4,437,282 | 3/1984 | O'Brien | 52/407 |
| 4,446,661 | 5/1984 | Jonsson et al. | 52/95 |
| 4,581,861 | 4/1986 | Eury | 52/95 |
| 4,679,370 | 7/1987 | Samuelsson | 52/407 |

*Primary Examiner*—Henry E. Raduazo

*Attorney, Agent, or Firm*—Donald A. Jacobson

[57] ABSTRACT

A cant vent stop is preformed and has perforated fold lines to fit under a cantilevered floor and provide air passage-ways to warm the cantilevered portion of the floor to prevent excessive coldness. The stop is moisture proof and protects the adjacent rim joist and insulation from moisture. A rim guard stop is moisture proof and is also preformed and perforated to fit over insulation installed adjacent to a rim joist to protect the insulation and rim from moisture. The rim guard can also be folded to fit over the end of the insulation installed under a cantilevered floor to protect the exposed end from moisture. Both stops are made of corrugated cardboard and are moisture proofed by aluminum foil on one side.

1 Claim, 6 Drawing Sheets

CANT VENT AND RIM GUARD AIR AND MOISTURE STOPS

BACKGROUND OF THE INVENTION

I. Field of the Invention

Increased amounts of insulation used in construction in recent years has caused problems relating to moisture control and inadvertent cold areas. These are new problems resulting from this additional use of insulation particularly in the rim joist area in modern standard construction techniques.

The rim joist boards extending around the periphery of a house were previously not insulated. The relatively large amount of heat loss through this vertical board was simply ignored. The present high cost of energy has resulted in using insulation, usually in the form of a fiberglas batt, fitted into the space between the floor joists on the sides where the rim joists are perpendicular to the floor joists, and attached along the rim joist on the sides where the rim joists are parallel to the floor joists. Using this approach it is essentially impossible to use a vapor barrier on the warm side of the insulation between the floor joists to keep moisture away from the rim joist because the insulation extends outward from the wall. The resulting moisture problem from this approach in homes only one or two years old has resulted in paint peeling from the outer surface of the exterior siding or the rim joists themselves rotting through. In some cases builders have attempted to cut and staple plastic sheeting over the insulation as a moisture barrier. Since the fiberglas insulation usually extends inward this is quite difficult. This approach is also very costly in the amount of labor required and unless a great deal of care is exercised in fitting the plastic sheating the vapor barrier is compromised with gaps and holes which leaves the problem unsolved.

Another problem related to the use of insulation occurs when the first floor of a dwelling is cantilevered outward as an extension from an exterior wall. This is a relatively inexpensive way of gaining additional space on the first and second floors, because the basement does not have to be increased in size to support this extension. The floor over this extension will become quite cold in the winter. This occurs because even if the extension is insulated under the floor, this merely slows the rate of heat flow which still results in a cold floor over the extension area.

II. Description of the Prior Art

A number of previous preformed members intended to be attached to building structures for various purposes have been patented. In Jonsson et al U.S. Pat. No. 4,446,661; Bentley U.S. Pat. No. 4,223,489; Kreimer U.S. Pat. No. 4,069,628; Reinke U.S. Pat. No. 1,924,515; Montgillion U.S. Pat. No. 498,563; O'Donnell U.S. Pat. No. 405,794; Clay U.S. Pat. No. 332,491; Samuelsson U.S. Pat. No. 4,679,370; and O'Brien U.S. Pat. No. 4,437,282, a variety of approaches in the use of preformed members adapted to control interior spaces and insulation, to provide moisture control and air gaps are disclosed. None of these inventions solve the specific problems addressed in the instant invention because these are new problems brought about by the new construction techniques discussed here.

SUMMARY OF THE INVENTION

The problem of moisture condensing on rim joists is solved by using a combined vapor barrier and insulation stop formed of cardboard, or other inexpensive material, and shaped to fit closely between the joists and over an extended fiberglas batt. Tabs extending from this barrier have prefolds sized and shaped to permit a presized barrier to be readily attached to a subfloor, joists or plates. This preshaped form can be manufactured to fit between any joist spacing and the extending tabs can be attached quickly by staple nailing or similar attachment with no cutting or fitting at all required. Since the barrier is dimensioned precisely for the shape and area to be covered, the barrier when in place completely covers the end of the fiberglas batt with no gaps or openings. The surface of the barrier facing the interior of the house is completely coated with aluminum foil, polyethelene or similar vaporproof material to provide a vapor barrier. This combination of a continuous barrier over the insulation with a vapor barrier solves the moisture problem. When this stop is used the paint will not blister and the rim joist remains free of any rot because moisture is prevented from reaching the rim joist area. As used here, this combined moisture barrier and insulation stop is called a rim guard.

The problem of cantilevered floors becoming excessively cold is solved by providing an air duct immediately above the insulation but below the extended floor. An air duct permits heated air from the interior of the structure to circulate above the insulation but below the cantilevered floor. This heated air will prevent the cantilevered floor from becoming cold. This air duct is provided by using a combined moisture barrier and insulation stop formed such as to provide an air channel above the insulation. This barrier is also formed of cardboard, or other relatively inexpensive material, and is preshaped to fit over the cantilevered insulation to provide the air duct channel. A vapor barrier is provided here also to protect the insulation below the cantilevered floor from moisture.

The center portion of the air duct is folded into a rectangular shaped channel, and the edges are folded in the same direction to provide sufficient ridgity in the barrier to withstand the upward force of partially fitted insulation. The readily accessible center portion and tabs extending in the opposite direction permit attaching the barrier to the overhead flooring end floor joists using stapling or similar fastening means. The side of the barrier facing the floor is covered with aluminum foil, polyethelene, or similar waterproof material, to provide the vapor barrier. The end of the barrier adjacent the cantilevered floor rim is made foldable upward to protect the rim from moisture. The opposite end of the barrier has the portions adjacent the tunnel foldable inward to keep moist air out of the tunnel and the remainder of the end foldable inward adjacent to the end of the insulation to permit installing a rim guard over the exposed insulation. A rim guard installed adjacent the cant vent is also folded downward to expose the end of the air duct. This eliminates the necessity of providing a vapor barrier on the insulation itself. This ducted barrier is called a cant vent as an abbreviation for a cantilever ventilator.

DETAILED DESCRIPTION OF THE PREFERRED EMBODIMENTS

Figure 1:
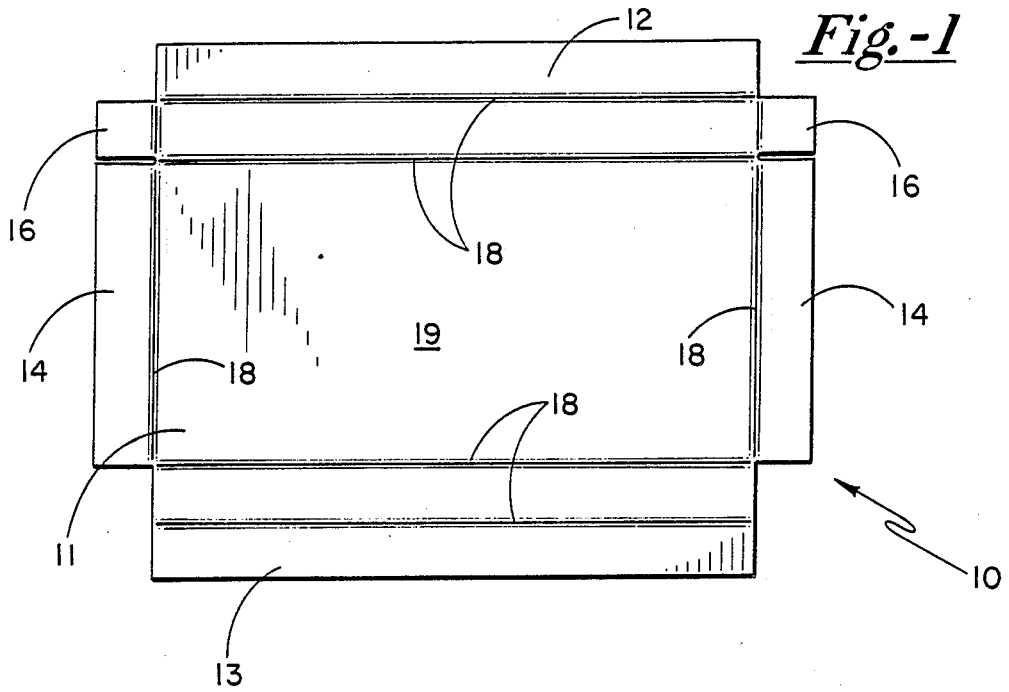
FIG. 1 is a plan view of a rim guard in a flat configuration.
Figure 2:
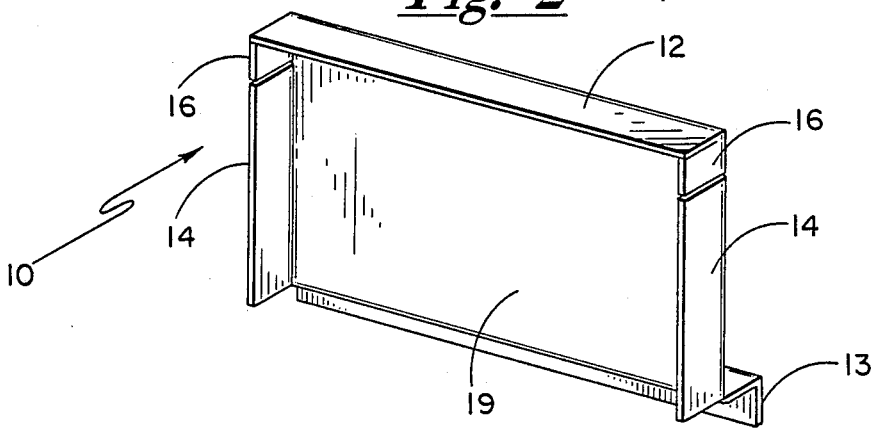
FIG. 2 is a perspective view of a rim guard in a first folded configuration.
Figure 3:
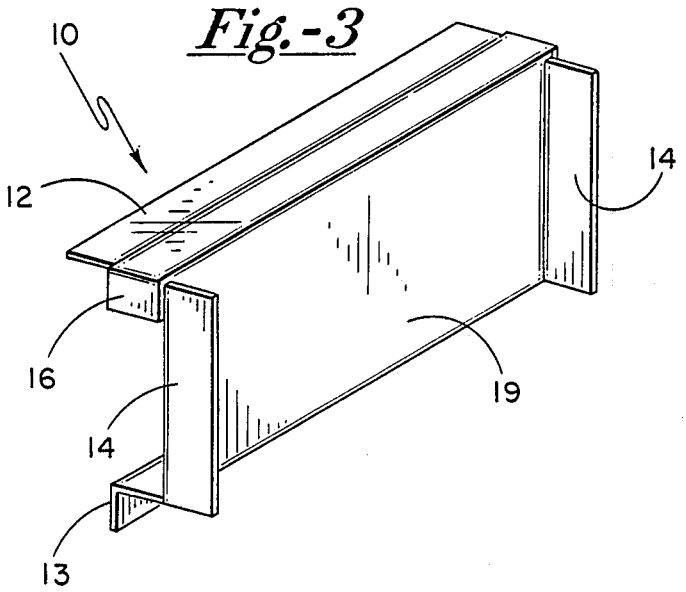
FIG. 3 is a perspective view of a rim guard in a second folded configuration.

In FIG. 1 a rim guard 10 is shown flat as for shipping. Top extensions 12, bottom extensions 13, side extensions 14 and corners 16 have perforations 18 with a cut along the side of corners 16 to define the inner boundaries, and to permit folding the extensions along the perforations relative to the center 19, and the corner relative to the top extensions. This assures that the fold will occur precisely along the perforations. Top extension 12 and bottom extension 13 have two perforations 18 providing two folds for each. Aluminum foil 11 is attached to the face exposed to the moist interior air to provide a vapor barrier. FIG. 2 shows the extensions folded with the aluminum foil 11 on the back side, not shown in this figure. The folds are made before the rim guard 10 is installed over insulation along a rim board. FIG. 3 shows the extensions folded as they are when the rim guard is installed adjacent to a cant vent to allow circulation through the cant vent as will be described later. Rim stop 10 is made of two layers of cardboard with a corrugated paper center and the shaping, cutting, perforating and coating are all performed with the conventional machinery used in the manufacture of cardboard boxes which are well known in that art. While aluminum foil is preferred as a vapor barrier, because of its fireproof characteristics, any vaporproof material which can readily be glued or coated onto a flat surface will suffice for a moisture barrier. The integrity of the vapor barrier provided is the prime consideration here, and a different material which would provide these necessary characteristics is acceptable. The use of aluminum foil provides assurance of a complete vapor barrier, provides fireproof characteristics and ruggedness to survive the rough handling which occurs on a construction site.

Figure 4:
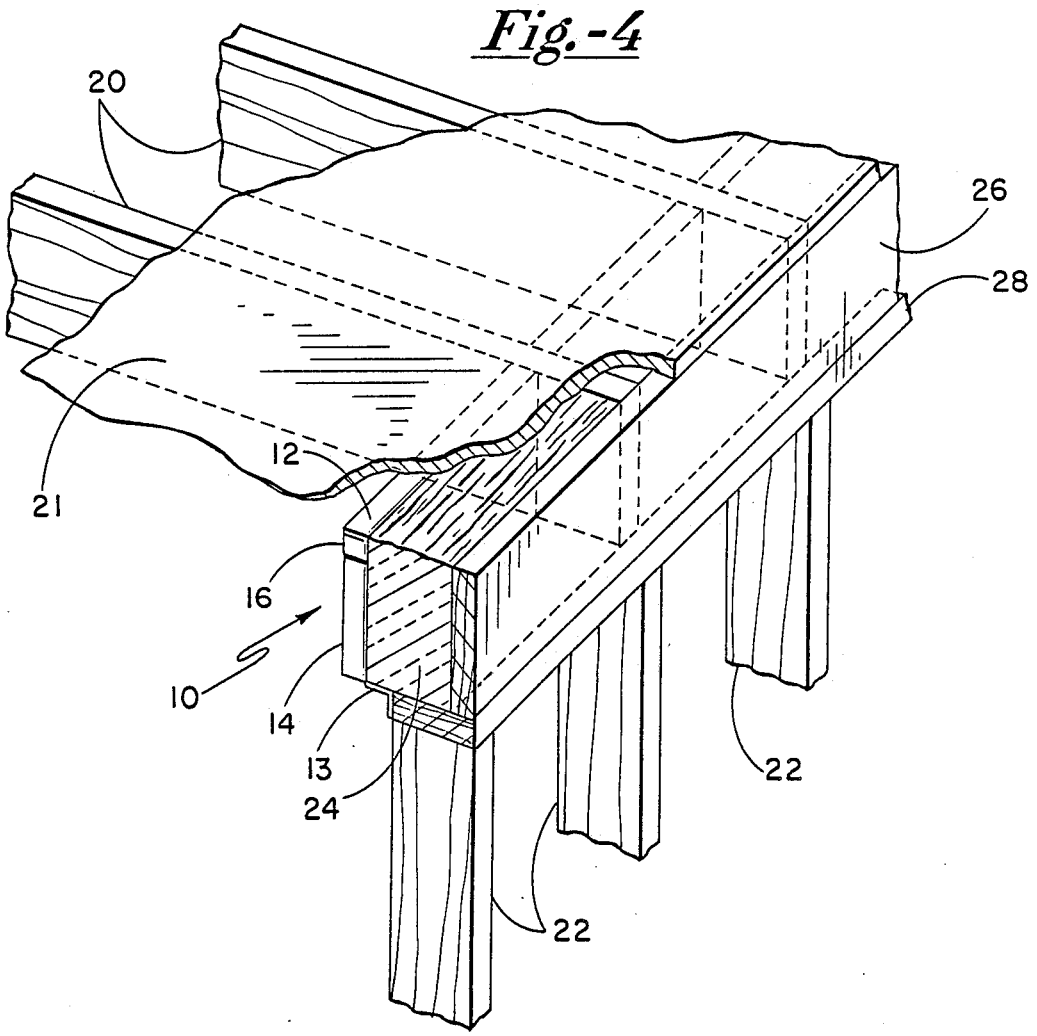
FIG. 4 is a perspective view of a rim guard mounted in place adjacent to a stud wall.

With rim guard 10 folded as shown in FIG. 2 it can be installed between the floor joists of a building. Aluminum foil 11 is on the back side here also and is not shown in this figure. Rim guard 10 is shown in FIG. 4 installed between floor joists 20 under flooring 21 by using staples through side extensions 14 and adjacent joists 20, through the outside top extension 12 and flooring 21, and through the outside fold of bottom extension 13 into the portion of top plate 28 located between studs 22. As shown a rim guard 10 holds a folded insulation batt 24 against rim joist 26. The double fold on bottom extension 13 permits batt 28 to extend beyond top plate 28 while still enclosing the batt with the outside portion of bottom extension 13 attached to the top plate while the inside bottom extension covers the portion of the insulation batt which extends inward past the top plate to provide a complete seal. The side of rim guard 10 exposed to the moist interior air is the side faced with aluminum foil so any moisture condensing from the warm interior air onto rim guard 10 will not come in contact with batt 28 as that would compromise the insulating value of the material.

Figure 5:
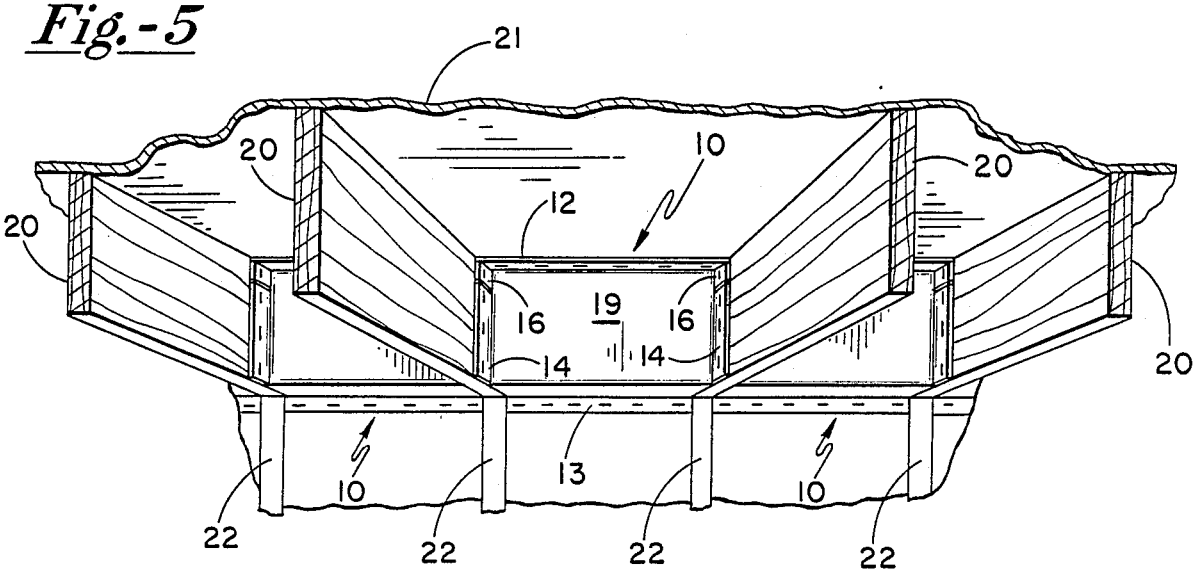
FIG. 5 is a perspective view of a rim guard mounted between a series of floor joists.

In FIG. 5 rim guard 10 is shown in another view mounted between joists 20 with the exterior folded outward to permit stapling the outer top extension 12 to the underside of flooring 21, side extensions 14 and corners 16 to joists 20, and the outside bottom extension 13 to plate 28, not shown in this figure. Rim guard 10 is presized to fit between any desired joist spacing and, when folded as shown, fits exactly between the joists as shown. No cutting is required on site to obtain this fit. Rim guard 10 is simply folded as shown with the moisture proof coating facing the warm air side to protect the enclosed insulation. After folding rim guard 10 to the configuration shown in FIG. 2 stapling the rim guard to the building structure as shown in FIG. 5 can be accomplished readily because all of the extensions are exposed next to the structure where they are to be attached. The extensions can also be nailed or attached by any desired means but stapling is preferred because of the speed and because the bridge of wire between the staple joints provides the maximum holding power.

Figure 6:
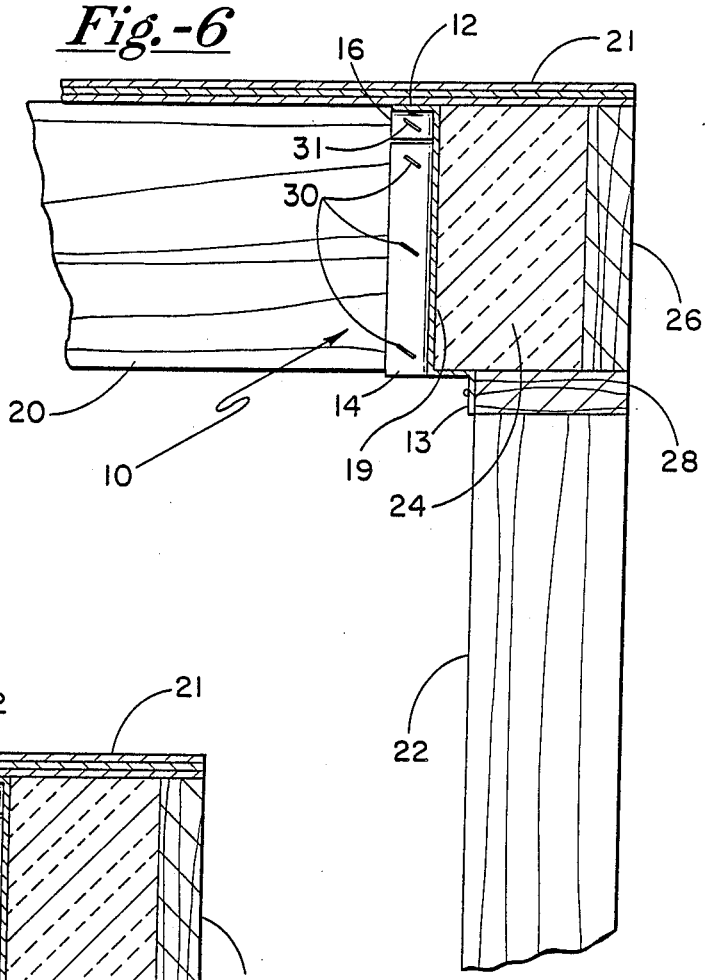
FIG. 6 is a cross-sectional view of a rim guard mounted adjacent to a stud wall.

In FIG. 6 rim guard 10 is shown mounted adjacent to insulation 24, which covers rim guard 26 and plate 28 which is supported by studs 22. Staples 30 secure side extension 14 to floor joist 20 and staple 31 secures corner 16 to the same floor joist. This arrangement is the same as that shown in FIGS. 4 and 5.

Figure 7:
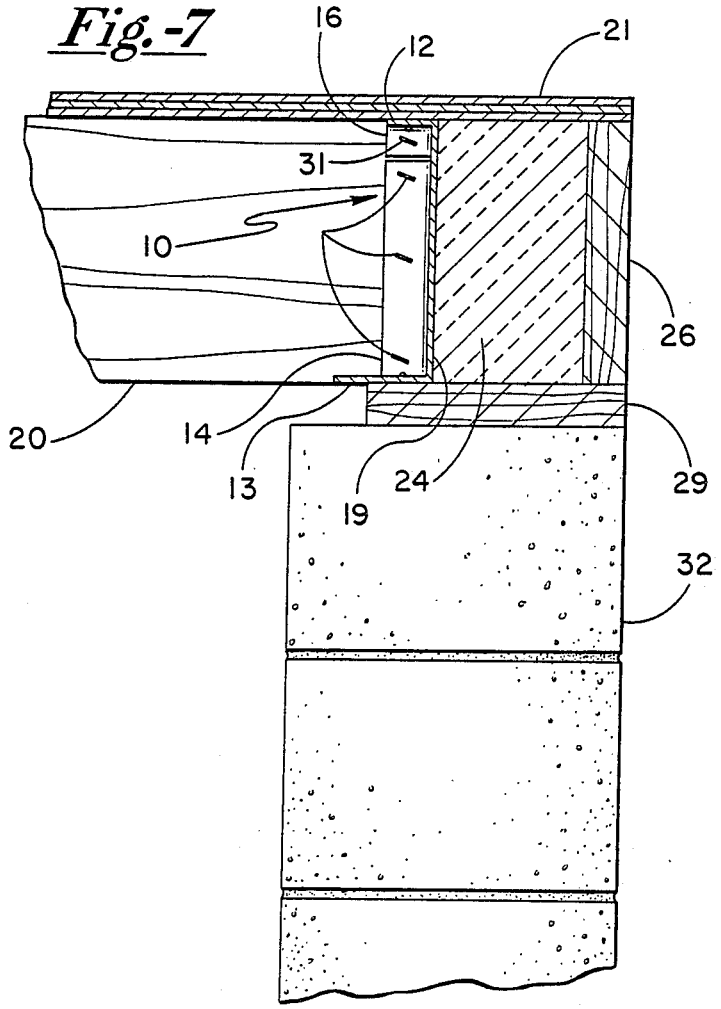
FIG. 7 is a cross-section view of a rim guard mounted adjacent to a cement block wall.

In FIG. 7 rim guard 10 is shown mounted adjacent to insulation 24, which covers rim guard 26 and plate 29 which is wider than plate 28 and is supported by concrete block wall 32. Here since plate 28 is wider insulation 24 does not extend beyond plate 29. To accomodate this change bottom extensions 13 are folded outward with no fold between the outer and inner bottom extension. This arrangement permits one rim guard design to be used with either supporting wall while still providing full protection and with no on site sizing required other than folding the rim guard along the proper perforated line.

Figure 10:
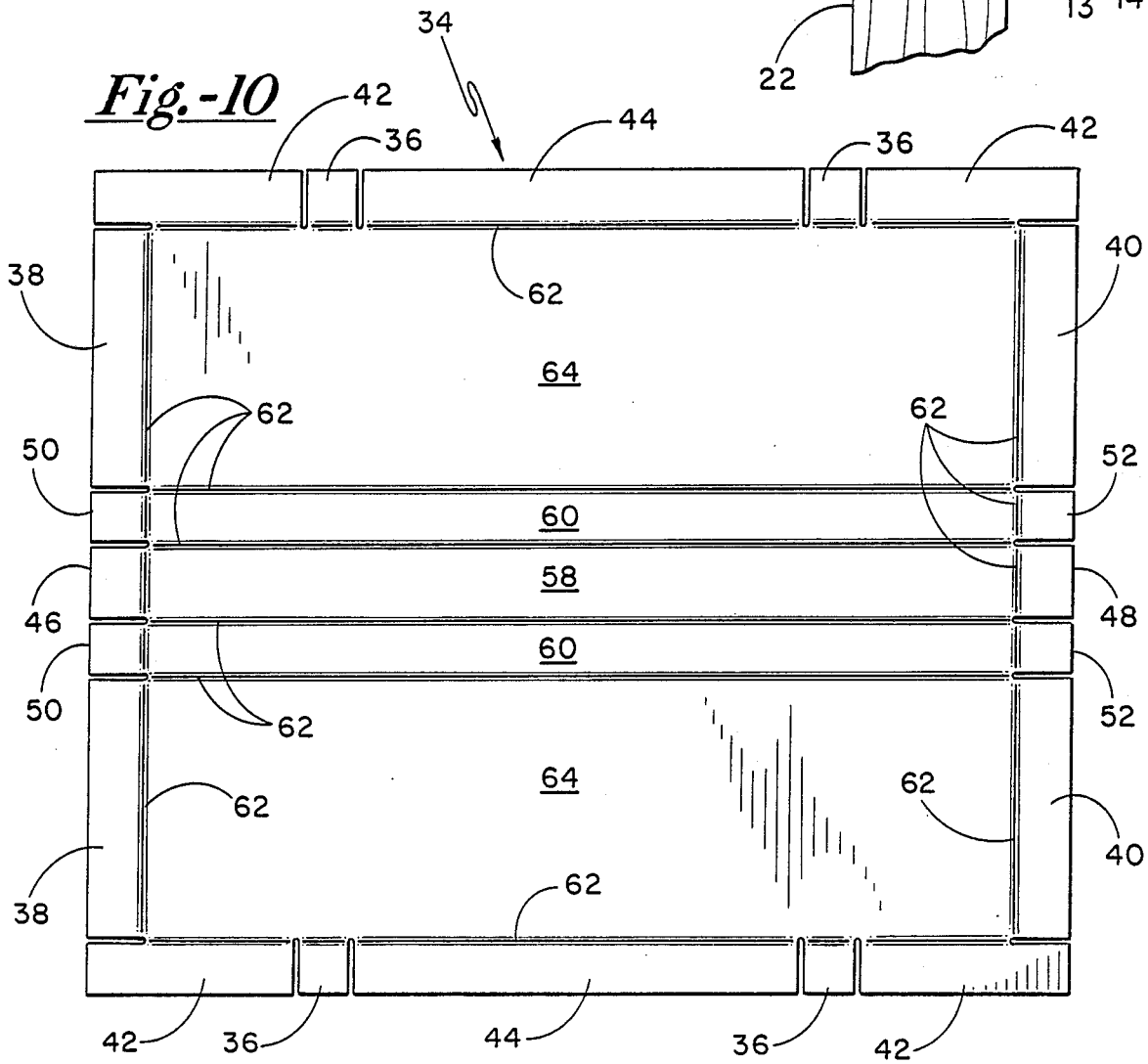
FIG. 10 is a plan view of a cant vent in a flat configuration.

In FIG. 10 cant vent 34 is shown flat as for shipping. Side tabs 36, end flaps 38 and 40, end side flaps 42, middle side flaps 44, tunnel flaps 46 and 48 and end tabs 50 and 52 have cuts defining a portion of their boundaries to permit folding these portions. Tunnel center 58 and tunnel sides 60 along with all of the portions having cuts to define part of their boundaries have perforations 62 to permit folding these portions with respect either to planar plates 64 or to tunnel center 58. The surface installed facing the interior warm air is covered with aluminum foil to provide a vapor barrier. Cant vent 34 is made of two layers of cardboard with a corrugated paper center and the shaping, cutting, perforating and coating are all performed with conventional machinery mentioned earlier used in the manufacture of cardboard boxes. Again, while aluminum foil is preferred as a vapor barrier because of its fireproof characteristics, any vapor proof material which can readily be glued or coated onto a flat surface will suffice for a moisture barrier.

Figure 11:
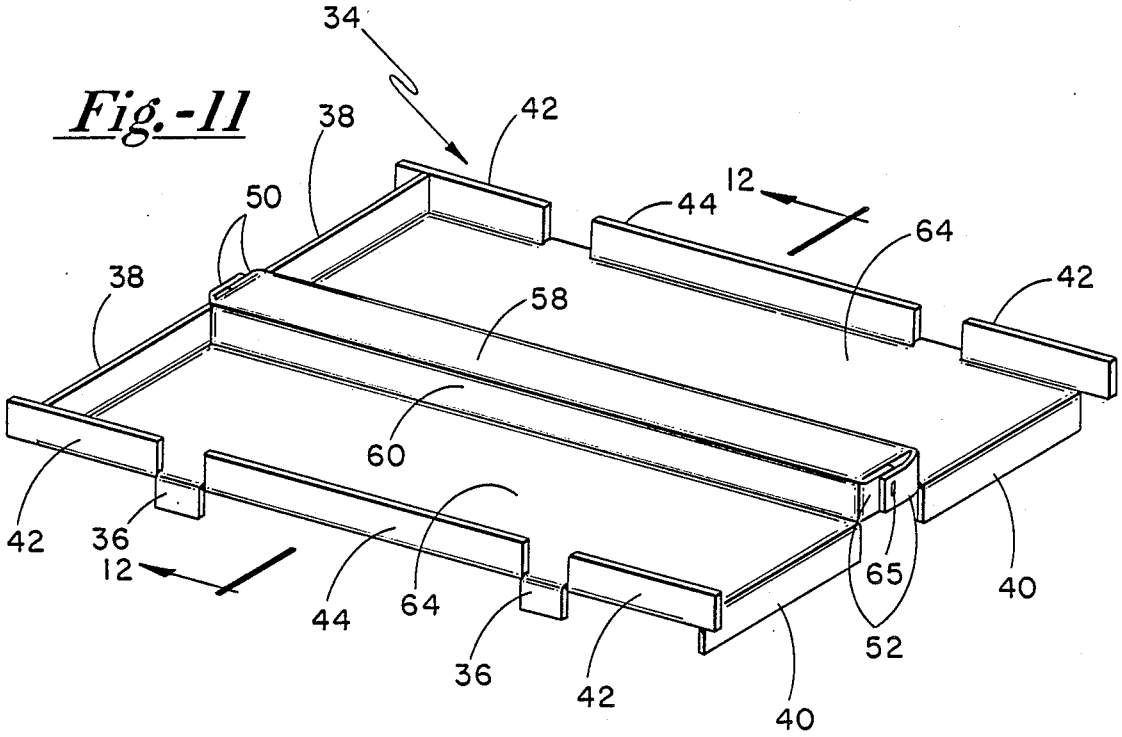
FIG. 11 is a perspective view of a cant vent folded for installation.
Figure 12:
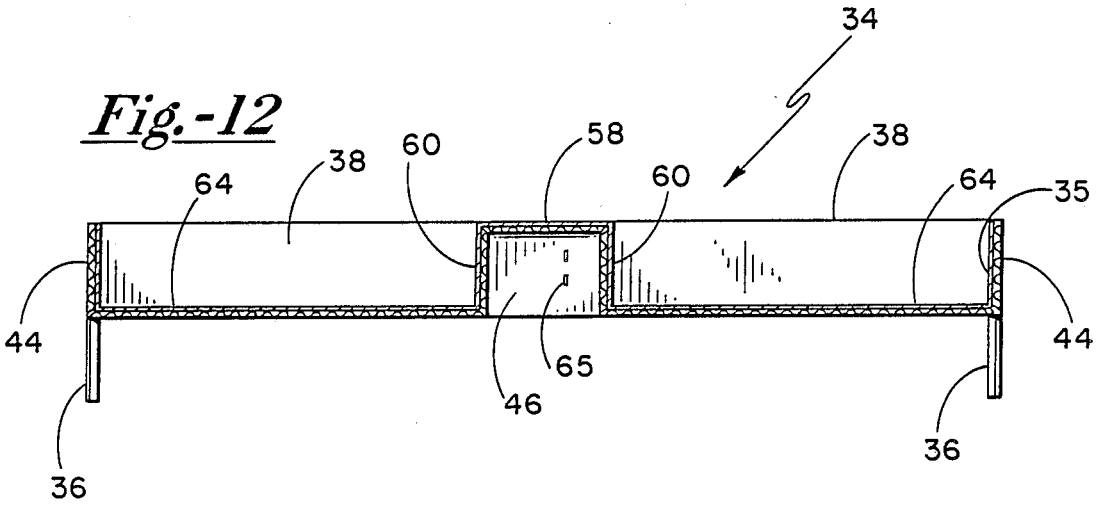
FIG. 12 is a cross-sectional view of a cant vent taken along view 12—12 of FIG. 11.

With cant vent 34 folded as shown in FIG. 11 it can be installed between the floor joists of a building under a cantilevered floor. Tabs 36 are turned downward on both sides to provide anchor points which are accessible with cant vent 34 in place against a floor. End tunnel sides 60 are folded downward from tunnel center 58 and perpendicular to plates 64 to form a tunnel in the center with end tabs 50 and 52 folded inward on each end and secured by a staple 65. This gives strength to the center section to prevent insulation from deforming the center section. Middle side flaps 44 and end side flaps 42 are folded upward and also provide structural integrity. End flaps 38 are folded upward because this is the end which is placed in contact with the rim plate and this shields the plate from moisture. FIG. 12 shows these members in cross-section. End flaps 40 are folded downward to provide access for warm interior air adjacent to the cantilevered floor. In FIG. 12 the openings leading to end flaps 38 and the accessibility of side tabs 36 can be seen.

Figure 8:
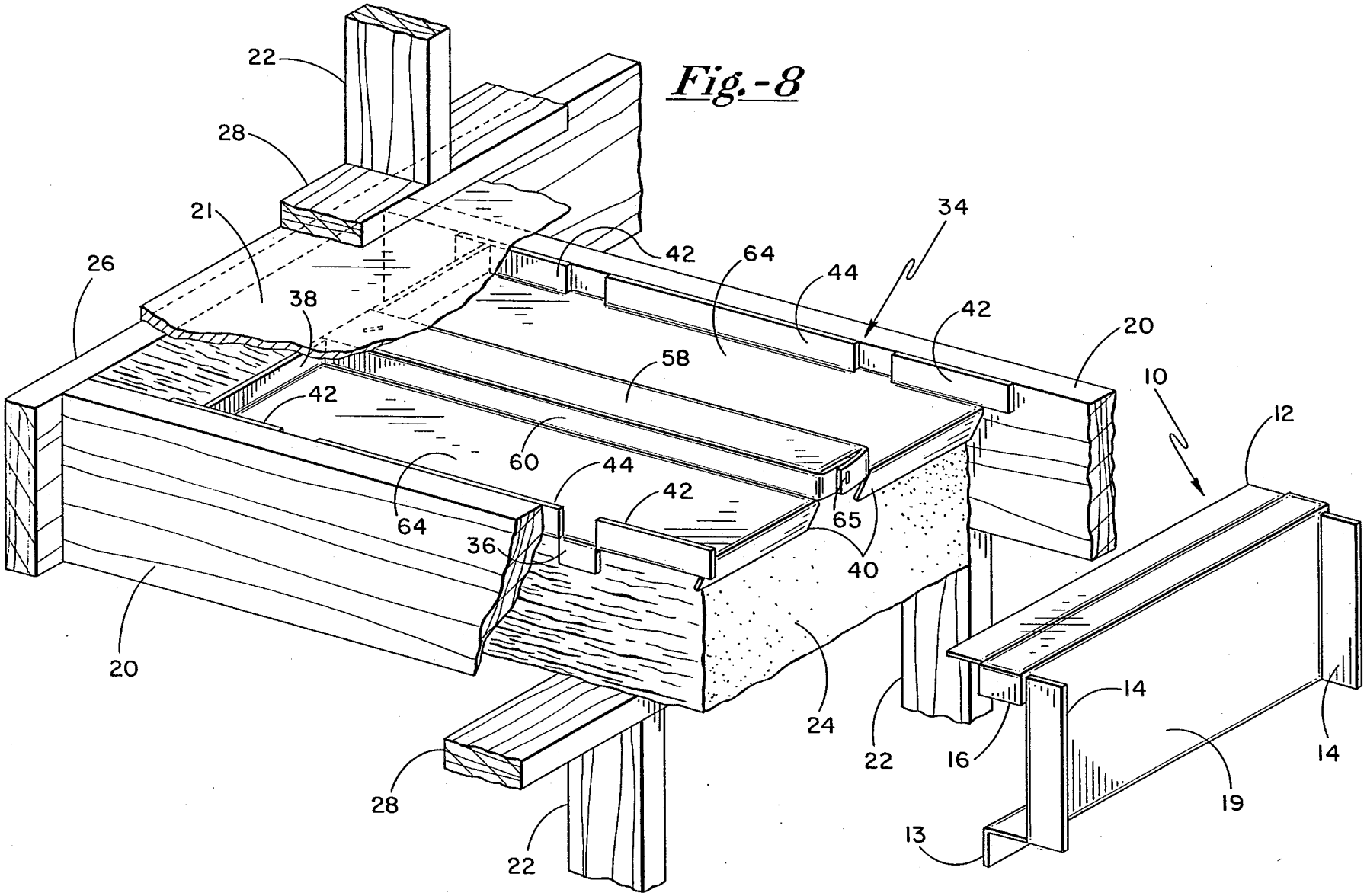
FIG. 8 is a perspective view of a cant vent mounted in place and a rim guard folded and oriented for mounting.

In FIG. 8 cant vent 34 is shown in position between floor joists 20 and adjacent to flooring 21. Prior to installation all that is necessary is to fold cant vent 34 as shown in FIG. 11 and staple end tabs 50 and 52 with a staple 65. After this minor preparation cant vent 34 is placed next to flooring 21 and stapled in position by staples through side tabs 36 which extend downward for this purpose. The surface of cant vent 34 facing upward is the side covered with aluminum foil to provide a moisture barrier for the insulation batt 24 and rim joist 26. After cant vent 34 is secured in place then insulation batt 24 can be installed.

Rim guard 10 is shown oriented and folded for installation over the exposed end of insulation batt 24. The side of rim guard 10 opposite insulation batt 24 is the side covered with aluminum foil to provide a moisture barrier. This is the second configuration of rim guard 10 as shown in FIG. 3.

Figure 9:
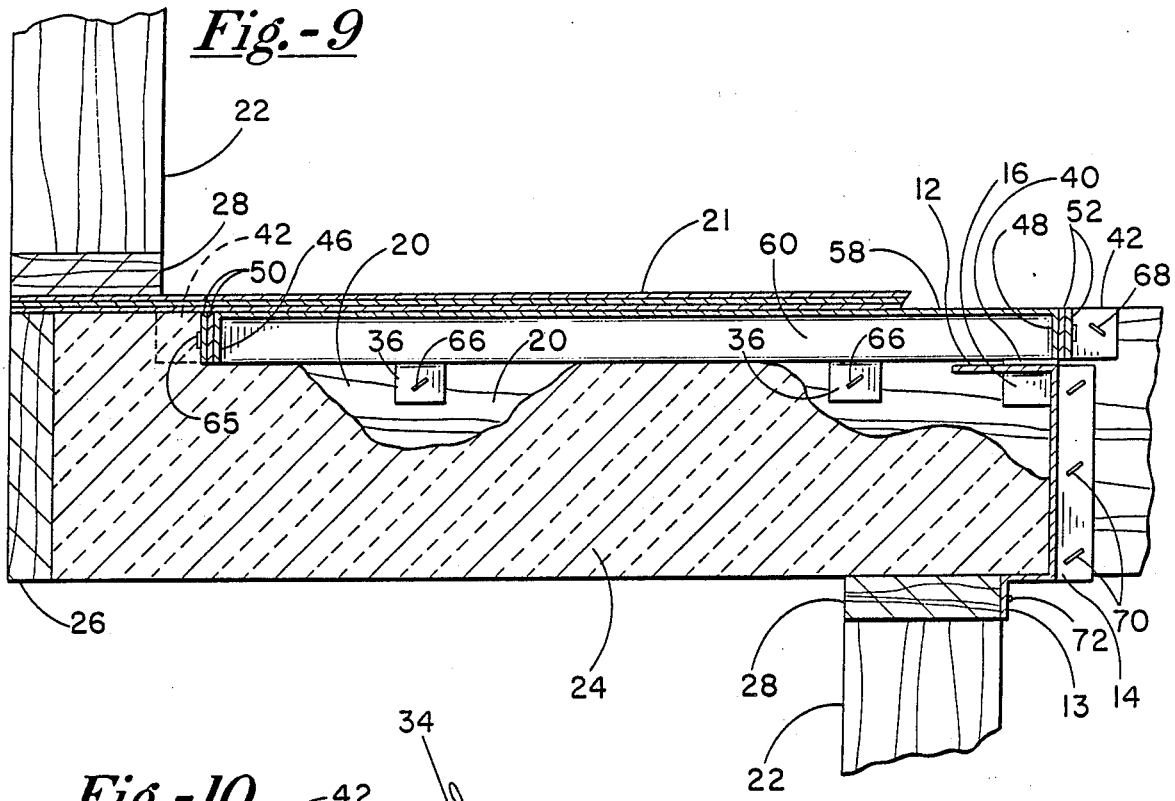
FIG. 9 is a cross-sectional perspective view of a rim guard and cant vent mounted in place taken through the center of the cant vent tunnel.

In FIG. 9 rim guard 10 is shown mounted in place over cant vent 34. End flaps 40 of cant vent 34 have been folded up over insulation 24 to permit top extension 12 of cant vent 10 to extend over the insulation to cover the end of the insulation. Side tabs 36 were secured with staples 66 before the insulation batt 24 was installed because the side tabs are accessible at that time. End side flap 42 is secured by staple 68, side extension 14 is secured by staples 70 and bottom extensions 13 are secured by staples 72. With this arrangement insulation batt 24 is covered along the top by cant vent 34 and along the exposed end by rim guard 10. This insures that no moisture will reach insulation batt 24.

Referring to FIG. 8 it can be seen that end flaps 38 cover rim joist 26 extending above insulation batt 24. On each side of tunnel center 58, tunnel sides 60, plates 64, end side flaps 42, and middle side flaps 44 form two passageways for warm air to pass under flooring 21 to keep the cantilevered portion of the floor warm. The tunnel formed of tunnel center 58 and tunnel sides 60 is closed on each end to prevent moist air from reaching rim joist 26. This combination of rim guard 10 and cant vent 34 protects rim joist 26 and insulation batt 24 from moisture while providing a path for warm air under the cantilevered portion of flooring 21 to provide heat for this area.

The two configurations of rim guard 10 along with the fact that the inside and outside bottom extensions 13 can be extended together as shown in FIG. 7 permit using one rim guard for all building situations including the use with cant vent 34 just described. The rim guard and cant vent are easy to install since they merely require folding along perforated lines to fit exactly within a building structure. Tunnel flaps 46 only have to be stapled together to complete the configuration of cant vent 34 to provide a tunnel structure with considerable strength which will not permit moist air reaching the rim joist. The versality of the cant vent eliminates the necessity of stocking a number of items for slightly different installation situations as illustrated.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

What is claimed is:

1. Apparatus for use in a building having a subfloor supported on a series of adjacent rafters, a rim board extending between said rafters, a rim support and exposed insulation provided between said rim support, subfloor and rafters, said apparatus adapted for covering the exposed insulation and for sealing the space between adjacent rafters, the rim support and the subfloor to keep air from entering said building, the apparatus comprising a generally rectangular rigid sheet having a first pair of edges extending along the major dimension of the rectangle and a second pair of edges extending along the minor dimension of the rectangle and having a first and a second pair of preformed perforated fold lines across said sheet with the first pair of fold lines oriented parallel to said first pair of edges and each line spaced a predetermined first distance inward from one of said first edges and with each of the second pair of fold lines spaced inward a second predetermined distance from a respective first fold line, and having a third pair of preformed perforated fold lines across said sheet oriented parallel to said second pair of edges, with the third pair of fold lines spaced a predetermined third distance inward from the respective adjacent edge of the second pair of outer edges, and having material removed from each corner of said sheet said removed portions comprising the rigid sheet material from said third fold lines to one of said first fold lines at a first pair of corners, and said removed portions further comprising the rigid sheet material from said third fold lines to one of said second fold lines at a second pair of corners; and having opposing cuts along the remaining second fold line of the second set of fold lines extending from the edges of the second pair of edges inward to the adjacent fold line of the third pair of fold lines; and having the dimensions of the sheet and of the first, second and third predetermined distances such that the distance between the third pair of fold lines is essentially equal to the spacing between adjacent rafters of a building and the spacing between the second pair of fold lines is essentially equal the height of a rim board.

* * * * *